US008734187B2

(12) United States Patent
De Geest et al.

(10) Patent No.: US 8,734,187 B2
(45) Date of Patent: May 27, 2014

(54) ELECTRICAL CONNECTOR WITH GROUND PLATES

(75) Inventors: Jan De Geest, Wetteren (BE); Stefaan Hendrik Jozef Sercu, Wuustwezel (BE); Stephen B. Smith, Mechanicsburg, PA (US); Douglas M. Johnescu, York, PA (US); Jonathan E. Buck, Hershey, PA (US)

(73) Assignees: FCI, Guyancourt (FR); FCI Americas Technology LLC, Carson City, NV (US)

( * ) Notice: Subject to any disclaimer, the term of this patent is extended or adjusted under 35 U.S.C. 154(b) by 158 days.

(21) Appl. No.: 13/166,081

(22) Filed: Jun. 22, 2011

(65) Prior Publication Data

US 2011/0318945 A1 Dec. 29, 2011

Related U.S. Application Data

(60) Provisional application No. 61/359,252, filed on Jun. 28, 2010.

(51) Int. Cl.
*H01R 24/00* (2011.01)

(52) U.S. Cl.
USPC ..... 439/626; 439/607.05

(58) Field of Classification Search
USPC ..... 439/607.05, 607.06, 607.1
See application file for complete search history.

(56) References Cited

U.S. PATENT DOCUMENTS

| | | | | |
|---|---|---|---|---|
| 6,293,827 | B1 | 9/2001 | Stokoe | |
| 7,118,391 | B2 | 10/2006 | Minich et al. | |
| 7,473,138 | B2 | 1/2009 | Tuin et al. | |
| 7,503,804 | B2 * | 3/2009 | Minich | 439/607.05 |
| 7,581,990 | B2 | 9/2009 | Kirk et al. | |
| 7,762,843 | B2 * | 7/2010 | Minich et al. | 439/607.05 |
| 8,226,441 | B2 * | 7/2012 | Regnier et al. | 439/626 |
| 2005/0009402 | A1 | 1/2005 | Chien et al. | |
| 2005/0148239 | A1 | 7/2005 | Hull et al. | |
| 2007/0296066 | A1 | 12/2007 | Shuey | |
| 2008/0316729 | A1 | 12/2008 | Rothermel et al. | |
| 2009/0159314 | A1 * | 6/2009 | Minich et al. | 174/250 |
| 2009/0221165 | A1 | 9/2009 | Buck et al. | |
| 2012/0214343 | A1 * | 8/2012 | Buck et al. | 439/607.05 |
| 2013/0017710 | A1 * | 1/2013 | Houtz | 439/374 |

* cited by examiner

*Primary Examiner* — Truc Nguyen
(74) *Attorney, Agent, or Firm* — Baker & Hostetler LLP

(57) ABSTRACT

An electrical connector and leadframe assemblies for use therein are provided. Each leadframe assembly can be constructed with at least one electric contact having a ground plate. A first type of leadframe assembly includes an uppermost electrical contact defining a ground plate. A second type of leadframe assembly includes a lowermost electrical contact defining a ground plate. The ground plates can reduce the level of crosstalk exhibited by the electrical connector.

11 Claims, 8 Drawing Sheets

ELECTRICAL CONNECTOR WITH GROUND PLATES

CROSS-REFERENCE TO RELATED APPLICATIONS

This application claims the benefit of U.S. Provisional Patent Application Ser. No. 61/359,252, filed on Jun. 28, 2010, the disclosure of which is incorporated herein by reference in its entirety.

BACKGROUND

Electrical connectors include connector housings and signal contacts that provide signal connections between electronic devices. Often, crosstalk is produced between adjacent signal contacts when a signal in one signal contact or one differential signal pair induces electrical interference in an adjacent signal contact or an adjacent differential signal pair due to interfering electrical fields, thereby compromising signal integrity. Crosstalk can be a significant concern when the signal contacts are spaced closely together, as crosstalk increases with reduced distance between the interfering signal contacts. One approach to connector design that can be used to reduce crosstalk is to separate adjacent signal contacts or adjacent differential signal pairs in an electrical connector with ground contacts. However, electrical connector design often dictates that the signal contacts should be spaced as close together as practicable in order to reduce the overall footprint of the electrical connector, and thus the overall space occupied by the electrical connector in a chassis or on a printed circuit board.

Accordingly, as high speed electrical systems are designed with smaller footprints and for increasingly higher operating frequencies, high signal integrity electronic communications and the reduction of crosstalk become a significant factor in connector design.

SUMMARY

In accordance with an embodiment, a leadframe assembly includes an electrically insulative leadframe housing that extends between a front end and an opposed rear end, and further extends between a lower end near an opposed upper end, and further includes a plurality of electrical contacts supported by the leadframe housing along a column direction, each electrical contact including a mating end disposed proximate to the front end of the leadframe housing, an opposed mounting end, and an intermediate section defined between the mating and mounting ends. At least a select one of the electrical contacts defines an integral ground plate that protrudes from the intermediate section of the select one of the plurality of electrical contacts along the column direction.

In accordance with another embodiment, an electrical connector includes a connector housing, a first leadframe assembly, and a second leadframe assembly. The first leadframe assembly is supported by the connector housing, and includes a first leadframe housing and a first plurality of electrical contacts supported by the first leadframe housing and arranged in a column direction. Each electrical contact of the first plurality of electrical contacts includes a mating end, an opposed mounting end, and an intermediate section disposed between the mating end and the mounting end. At least a select one of the first plurality of electrical contacts defines a first ground plate that protrudes from the intermediate section of the select one of the first plurality of electrical contacts along a first direction. The second leadframe assembly is supported by the connector housing, and includes a second leadframe housing and a second plurality of electrical contacts supported by the second leadframe housing and arranged in a column direction. Each electrical contact of the second plurality of electrical contacts includes a mating end, an opposed mounting end, and an intermediate section disposed between the mating end and the mounting end. At least a select one of the second plurality of electrical contacts defines a second ground plate that protrudes from the intermediate section of the select one second plurality of electrical contacts along a second direction that is different than the first direction.

BRIEF DESCRIPTION OF THE DRAWINGS

The foregoing summary, as well as the following detailed description of example embodiments of the application, will be better understood when read in conjunction with the appended drawings. For the purposes of illustrating the electrical connector with ground plates, there are shown in the drawings example embodiments. It should be understood, however, that the instant application is not limited to the precise arrangements and/or instrumentalities illustrated in the drawings, in which.

DETAILED DESCRIPTION

Figure 1:
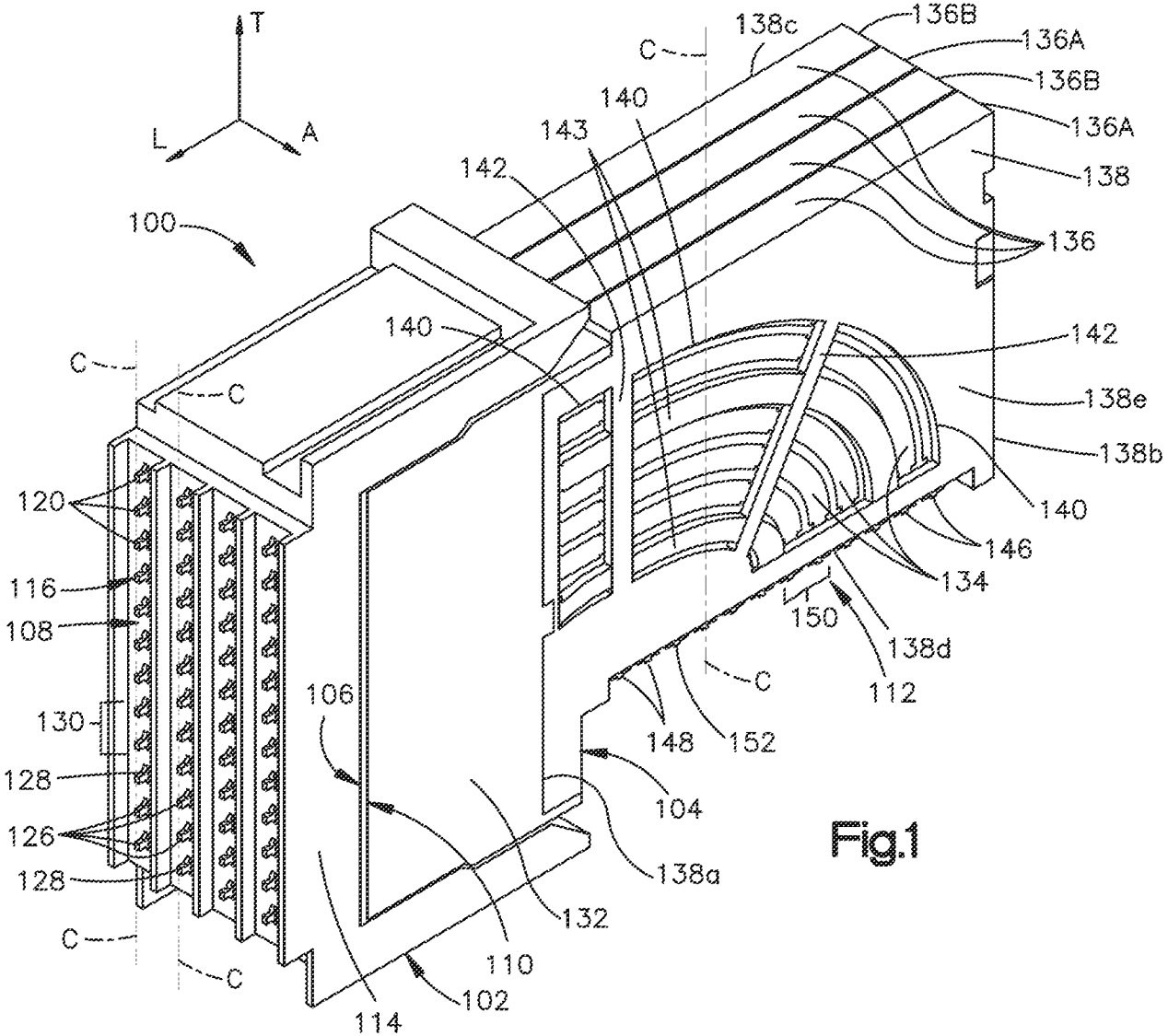
FIG. 1 is a perspective view of an electrical connector assembly, including a right angle electrical connector constructed in accordance with one embodiment, and a complementary vertical connector mated to the right angle connector.

For convenience, the same or equivalent elements in the various embodiments illustrated in the drawings have been identified with the same reference numerals. The words "right", "left", "upper," and "lower" designate directions in the drawings to which reference is made. The terms "inner," "inward," "inwardly," "outer," "outward," "outwardly,"

"upward," "upwardly," "downward," and "downwardly" refer to directions toward and away from, respectively, the geometric center of the structure referred to and designated parts thereof. The terminology intended to be non-limiting includes the above-listed words, derivatives thereof and words of similar import.

Figure 2A:
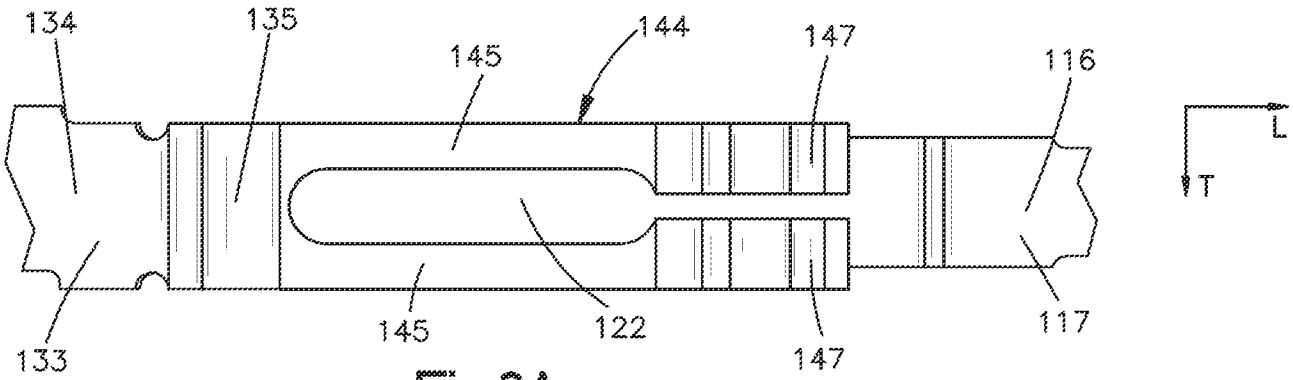
FIG. 2A is a top plan view of a mating interface of the electrical connector assembly illustrated in FIG. 1.
Figure 2B:
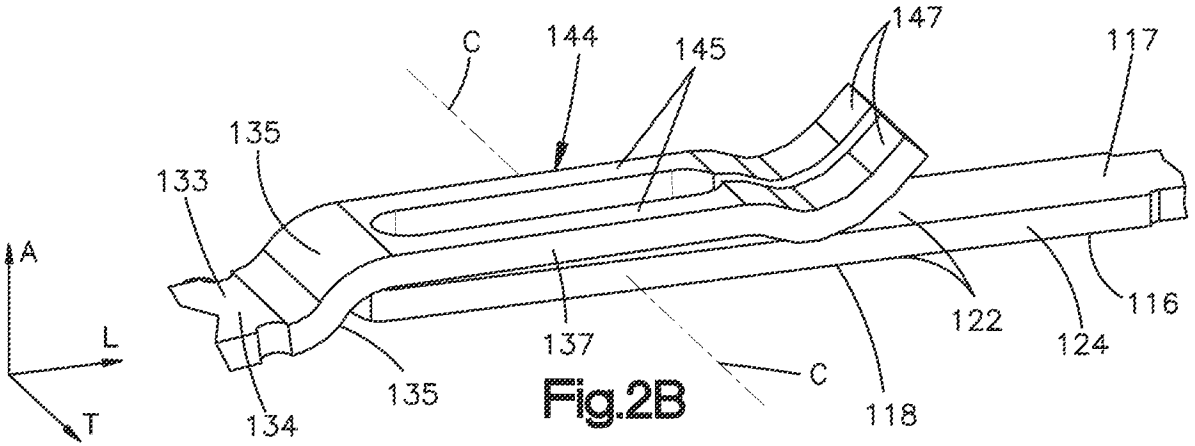
FIG. 2B is a perspective view of the mating interface of the electrical connector assembly illustrated in FIG. 2A.

In accordance with one embodiment, crosstalk typically exhibited by electrical connectors can be reduced by disposing one or more electrical contacts with ground plates in an electrical connector. Referring initially to FIGS. 1-2B, an electrical connector assembly 100 includes a first electrical connector 102 configured to mate with a complementary second electrical connector 104 so as to establish an electrical connection between complementary electrical components, for instance substrates such as printed circuit boards, electrical devices, or the like. In the illustrated embodiment, the first electrical connector 102 can be a vertical connector defining a mating interface 106 and a mounting interface 108 that is oriented substantially parallel to the mating interface 106. The second electrical connector 104 can be a right-angle connector defining a mating interface 110 and a mounting interface 112 that is oriented substantially perpendicular to the mating interface 110. The first and second electrical connectors 102 and 104 are configured to mate with each other at their respective mating interfaces 106 and 110, and are each configured to be mounted to a respective complementary electrical component, such as a substrate, for instance a printed circuit board, at their mounting interfaces 106 and 112.

The first electrical connector 102 includes a dielectric, or electrically insulative, connector housing 114 and a plurality of electrical contacts 116 that are carried by the connector housing 114. Any suitable dielectric material, such as air or plastic, may be disposed between the electrical contacts 116 so as to isolate adjacent electrical contacts 116 from one another. The electrical contacts 116 can be overmolded by the connector housing 114, stitched into the connector housing 114, or otherwise supported by the connector housing 114 as desired.

Each electrical contact 116 can include a contact blade 117 (FIG. 2A) that defines a mating end 118 (FIG. 2A) that is disposed proximate to the mating interface 106 and an opposed mounting end 120 that is disposed proximate to the mounting interface 108. Thus, the mating ends 118 are spaced along the mating interface 106 and the mounting ends 120 are spaced along the mounting interface 108. The contact blades 117 of the electrical contacts 116 extend between the mating and mounting ends 118, 120 along a longitudinal direction L. Furthermore, the first and second electrical connectors 102 and 104 are mated along a longitudinal insertion direction. Also, the mating interface 106 of the first electrical connector 102 is spaced from the mounting end 108 along the longitudinal direction L. Each of the electrical contacts 116 can define respective first and second opposed broadsides 122 that are spaced apart along a lateral direction A that is substantially perpendicular to the longitudinal direction L, and first and second edges 124 connected between the broadsides and spaced apart along a transverse direction T that is substantially perpendicular to both the longitudinal and lateral directions L, A, respectively. The edges 124 define a cross-sectional length less than that of the broadsides 122, such that the electrical contacts 116 define a rectangular cross section. The mounting ends 120 can be configured as press-fit tails, surface mount tails, fusible elements such as solder balls, or otherwise configured so as to electrically connect to electrical traces of an underlying substrate, such as a printed circuit board, which can be configured as a backplane, midplane, daughtercard, or the like.

In accordance with the illustrated embodiment, the longitudinal direction L and the lateral direction A are oriented horizontally, and the transverse direction T is oriented vertically, though it should be appreciated that the orientation of the electrical connector assembly 100 can vary during use. The electrical connectors 102, 104 are configured to be mated along a longitudinally forward insertion direction, and unmated along an opposed longitudinally rearward direction. Unless otherwise specified herein, the terms "lateral," "laterally," "longitudinal," "longitudinally," "transverse," and "transversely" are used to designate perpendicular directional components in the drawings to which reference is made.

The electrical contacts 116 can include signal contacts 126 that can be single ended, or configured such that adjacent signal contacts 126 along a common column C define differential signal pairs 130. The electrical contacts 116 can further include ground contacts 128 that can be disposed between adjacent signal contacts 126, for instance between adjacent differential signal pairs 130. In accordance with one embodiment, the differential signal pairs 130 are edge coupled, that is the edges 124 of each pair of electrical contacts 116 that defines a differential pair 130 face each other along a common column C. Thus, the electrical connector 102 can include a plurality of differential signal pairs 130 spaced along a given column C. It should be appreciated that the first electrical connector 102 is not limited to four differential signal pairs 130 positioned edge-to-edge along a respective column C, and that any the first electrical connector 102 can include any number of differential signal pairs 130 along a given column C as desired. The columns C are spaced apart along the lateral direction A.

The mating ends 118 of the electrical contacts 116 can be configured as spade, or plug type mating ends. Accordingly, the first electrical connector 102 can be referred to as a plug or header connector. Furthermore, because the mating interface 106 is oriented substantially parallel to the mounting interface 108, the first electrical connector 102 can be referred to as a vertical connector, though it should be appreciated that the first electrical connector 102 can alternatively be provided in any desired configuration so as to electrically connect an underlying substrate, such as a printed circuit board, to the second electrical connector 104. For instance, the first electrical connector 102 can alternatively be constructed as a receptacle connector with electrical contacts 116 having receptacle type mating ends configured to receive complementary spade type mating ends of the electrical contacts of a complementary electrical connector that is to be mated to the first electrical connector 102. Additionally, the first electrical connector 102 can be configured as a right-angle connector, whereby the mating interface 106 is oriented substantially perpendicular to the mounting interface 108.

With continuing reference to FIGS. 1-2B, the second electrical connector 104 includes a dielectric, or electrically insulative, connector housing 132 and a plurality of electrical contacts 134 that are supported by the connector housing 132. Any suitable dielectric material, such as air or plastic, may be used to isolate the electrical contacts 134 from one another. Each electrical contact 134 includes a contact beam 133 that defines a mating end 144 disposed proximate to the mating interface 110, and an opposed mounting end 146 disposed proximate to the mounting interface 112. The mating ends 144 are thus spaced along the mating interface 110, and the mounting ends 146 are spaced along the mounting interface 112. In accordance with the illustrated embodiment, the electrical contacts 134 can define receptacle type mating ends 144. Each of the electrical contacts 134 can define respective first and second opposed broadsides 135 that are spaced apart along the lateral direction A, and first and second edges 137 connected between the broadsides 135 and spaced apart along the transverse direction T. The edges 137 define a length less than that of the broadsides 135, such that the electrical contacts 134 define a rectangular cross section. When the electrical contacts 134 are disposed edge-to-edge along a common column C, the electrical contacts 134 can define opposed upper and lower edges 137*a*, 137*b*, respectively (see FIGS. 4, 6).

In accordance with the illustrated embodiment, the mating ends 144 of the electrical contacts 134 extend substantially horizontally forward along the longitudinal direction L, and the mounting ends 146 extend substantially vertically down along the transverse direction T. The mating ends 144 are configured to contact the complementary header type mating ends 118 of the electrical contacts 116 of the first electrical connector 102 when the first and second electrical connectors 102 and 104 are mated along the longitudinal direction L. For instance each mating end 144 may be laterally offset with respect to the column C in which the complementary electrical contact 116 is disposed such that the mating ends 144 contact one lateral side of the respecting mating ends 118 of the complementary electrical contacts 116. Alternatively, the mating ends 144 can be offset in alternating directions. That is, the mating end 144 of a first electrical contact 134 can be offset from the column C in a first direction that is perpendicular to the column C, and the mating end 144 of a second, adjacent electrical contact 134 positioned along the same column C can be offset from the column C in a second direction that is opposite the first direction. The mating ends 144 can be constructed to engage the blade type mating ends 118 of the electrical contacts 116 of the first electrical connector 102. For example, in accordance with the illustrated embodiment, the mating ends 144 can include split beams 145. The split beams 145 can define tips 147 that can be curved inwardly toward the column C then outwardly away from the column C as the beams 145 extend longitudinally forward toward the first electrical connector 102 along the longitudinally forward insertion direction.

The electrical contacts 134 can include signal contacts 148 that can be single ended, or configured such that adjacent signal contacts 148 along a common column C define differential signal pairs 150. The electrical contacts 134 can further include ground contacts 152 that can be disposed between adjacent signal contacts 148, for instance between adjacent differential signal pairs 150. In accordance with one embodiment, the differential signal pairs 150 are edge coupled, that is the edges of each electrical contact 134 of a given differential signal pair 150 face each other along a common column C. The mating ends 144 of the electrical contacts 134 are configured to electrically connect to the mating ends 118 of the complementary electrical contacts 116 when the first and second electrical connectors 102 and 104 are mated, such that the complementary signal contacts 126 and 148 mate, and the complementary ground contacts 128 and 152 mate. The mounting ends 146 can be constructed as described above with respect to the mounting ends 120 of the electrical contacts 118, and thus can be constructed as press-fit tails, surface mount tails, fusible elements such as solder balls, or otherwise configured so as to electrically connect to electrical traces of an underlying substrate, such as a printed circuit board, which can be configured as a backplane, midplane, daughtercard, or the like.

Because the mating ends 144 of the electrical contacts 134 are configured as receptacle type mating ends, the second electrical connector 104 can be referred to as a receptacle connector. Furthermore, because the mating interface 110 is oriented substantially perpendicular to the mounting interface 112, the second electrical connector 104 can be referred to as a right angle connector, though it should be appreciated that the second electrical connector 104 can alternatively be provided in any desired configuration so as to electrically connect an underlying substrate, such as a printed circuit board, to the first electrical connector 102. For instance, the second electrical connector 104 can alternatively be constructed as a plug or header connector with electrical contacts 134 having spade, or plug type mating ends configured to be plugged into, or received by complementary receptacle type mating ends of the electrical contacts of a complementary electrical connector that is to be mated to the second electrical connector 104. Additionally, the second electrical connector 104 can be configured as a vertical connector, whereby the mating interface 110 is oriented substantially parallel to the mounting interface 112.

The electrical contacts 134 of the second electrical connector 104 can be carried by a plurality of leadframe assemblies 136 supported by in the connector housing 132. Each leadframe assembly 136 includes a dielectric, or electrically insulating, leadframe housing 138 that carries a respective plurality of the electrical contacts 134 spaced along a common transverse column C. Each leadframe housing 138 defines a front end 138*a* disposed proximate to the mating ends 144 of the electrical contacts 134 and an opposed rear end 138*b* that is rearwardly spaced from the front end 138*a* along the longitudinal direction L. The mating ends 144 extend longitudinally forward from the front end 138*a*. Each leadframe housing 138 further defines an upper end 138*c* and an opposed lower end 138*d* that extend between the front and rear ends 138*a* and 138*b*. The upper end 138*c* is spaced from the lower end 138*d* along the transverse direction T. The lower end 138*d* is disposed proximate to the mounting ends 146 of the electrical contacts 134. Each leadframe housing 138 further defines laterally opposed side surfaces 138*e*.

Figure 7:
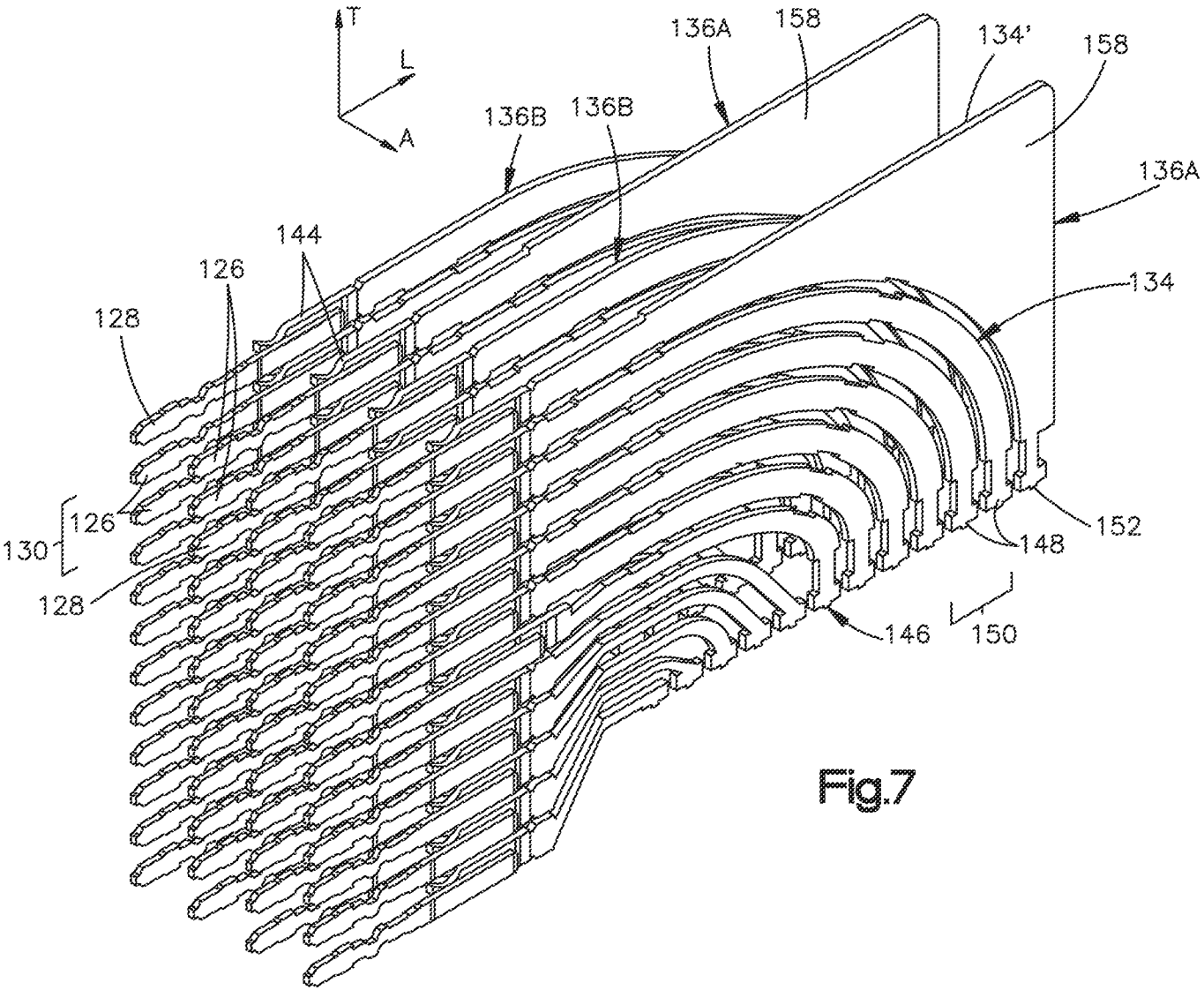
FIG. 7 is a top perspective view of the electrical connector assembly illustrated in FIG. 1, with the respective housings removed, so as to illustrate the electrical contacts of the first and second type leadframe assemblies illustrated in FIGS. 3-6 as they are arranged in the right angle connector housing and mated to the complementary electrical contacts of the vertical connector.
Figure 8:
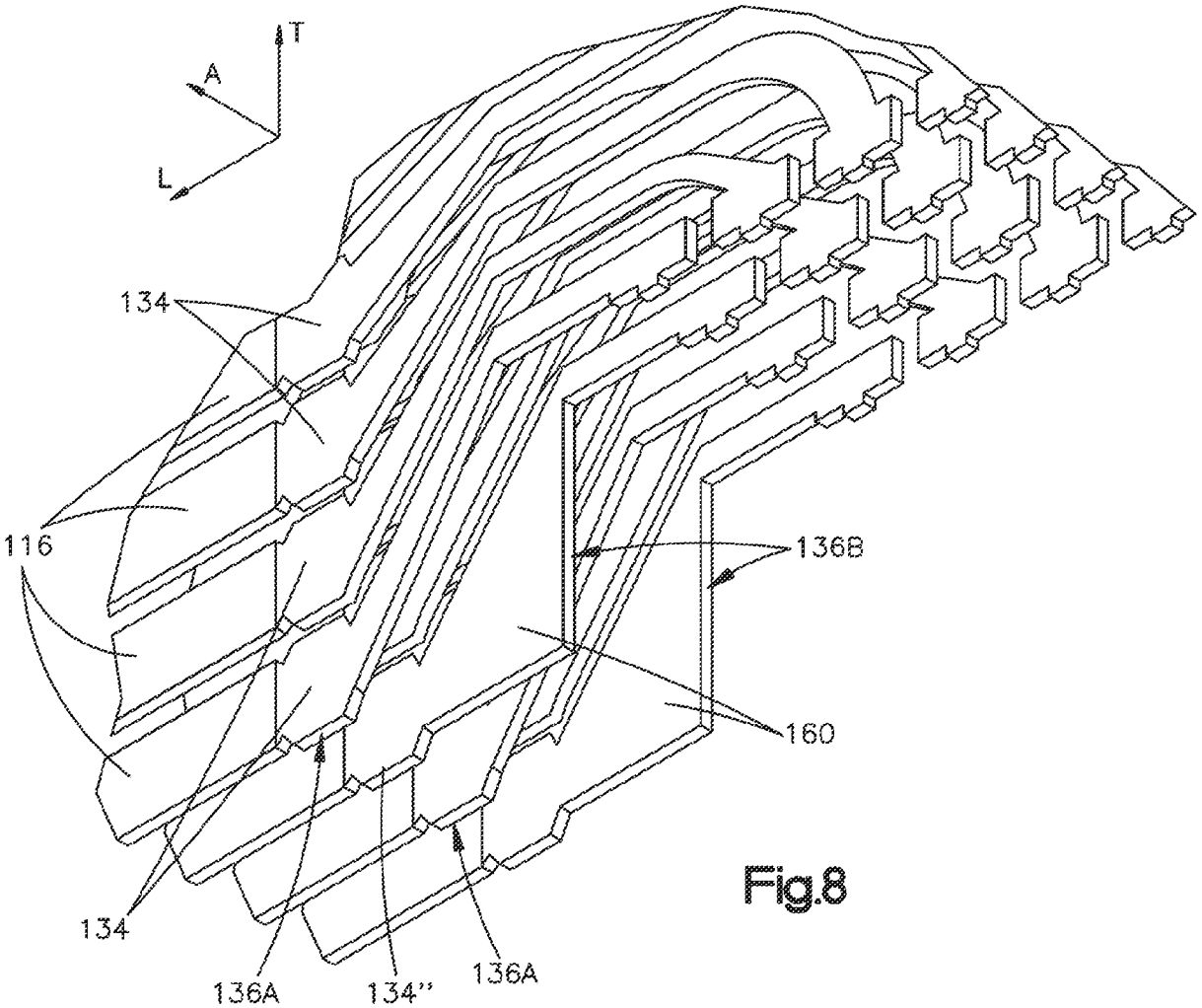
FIG. 8 is a bottom perspective view of a portion of the electrical contacts illustrated in FIG. 7.

The second electrical connector 104 can include a plurality of leadframe assemblies 136, which can include first and second different types of leadframe assemblies 136A and 136B. In accordance with the illustrated embodiment, the leadframe assemblies 136A and 136B can be laterally spaced in the connector housing 132 and alternatingly arranged across the second electrical connector 104 along the lateral direction A (see FIGS. 7-8). Thus, each first type of lead frame assemblies 136A can be disposed adjacent, or between, second types of leadframe assemblies 136B, and each second type of lead frame assemblies 136B can be disposed adjacent, or between, first types of leadframe assemblies 136A. Alternatively, the second electrical connector 104 can be constructed with any leadframe assemblies 136 as desired.

The first type 136A of leadframe assembly 136 can define an arrangement of the electrical contacts 134 in a repeating ground-signal-signal pattern along the mating interface 110 in a downward direction between the upper and lower ends 138*c*, 138*d* of the leadframe housing 138. The second type 136B of leadframe assembly 136 can define an arrangement of the electrical contacts 134 in a repeating signal-signal-ground pattern along the mating interface 110 in a downward direction between the upper and lower ends 138*c*, 138*d* of the leadframe housing 138. Thus, the first type 136A of leadframe assembly 136 can define a first pattern of signal contacts 148 and ground contacts 152, and the second type of leadframe assembly 136B can define a second pattern of signal contacts 148 and ground contacts 152 that is different than the first pattern. Alternatively, the first and second types of leadframe assemblies 136A and 136B can define the same pattern of signal and ground contacts.

In accordance with illustrated embodiment, the leadframe assemblies 136 can be configured as insert molded leadframe assemblies (IMLAs), whereby the leadframe housing 138 is overmolded onto the electrical contacts 134. Alternatively, the electrical contacts 134 can be stitched or otherwise supported by the leadframe housing 138. One or more portions of the leadframe housing 138 can be open, for instance the leadframe housing 138 can define at least one, such as a plurality of openings 140, the openings 140 exposing respective portions, such as the broadsides, of at least one, such as a plurality of the electrical contacts 134 to air. The openings 140 can be separated by one or more ribs 142 defined by the leadframe housing 138. The leadframe housing 138 can further define at least one, such as a plurality of insulative ribs 143 that extend substantially parallel to intermediate sections 155 (see also FIG. 4) of a select one or more of the electrical contacts 134.

Figure 3:
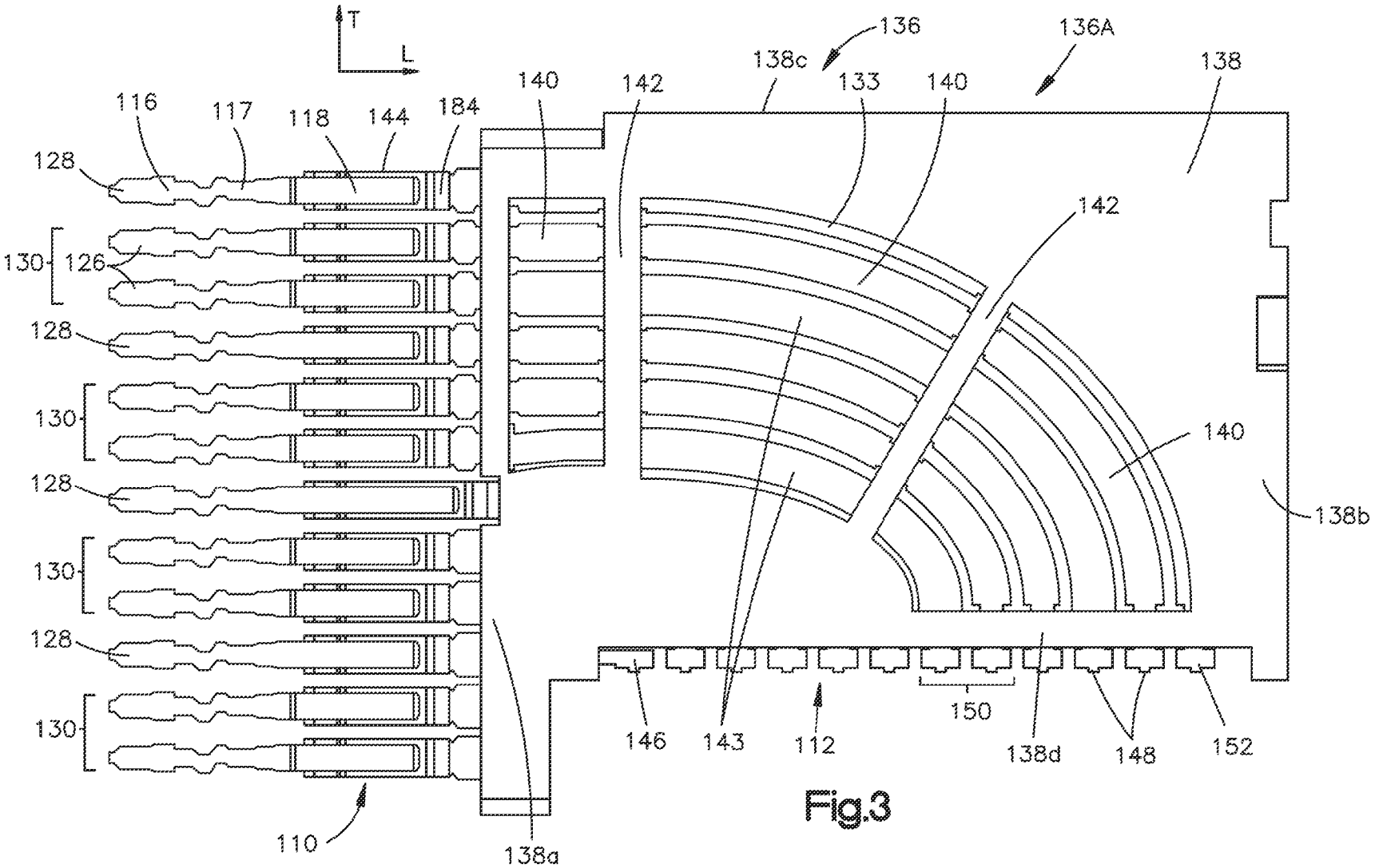
FIG. 3 is a side elevation view of a first type of leadframe assembly of the right angle electrical connector illustrated in FIG. 1 including electrical contacts shown mated to complementary electrical contacts of the vertical connector.
Figure 4:
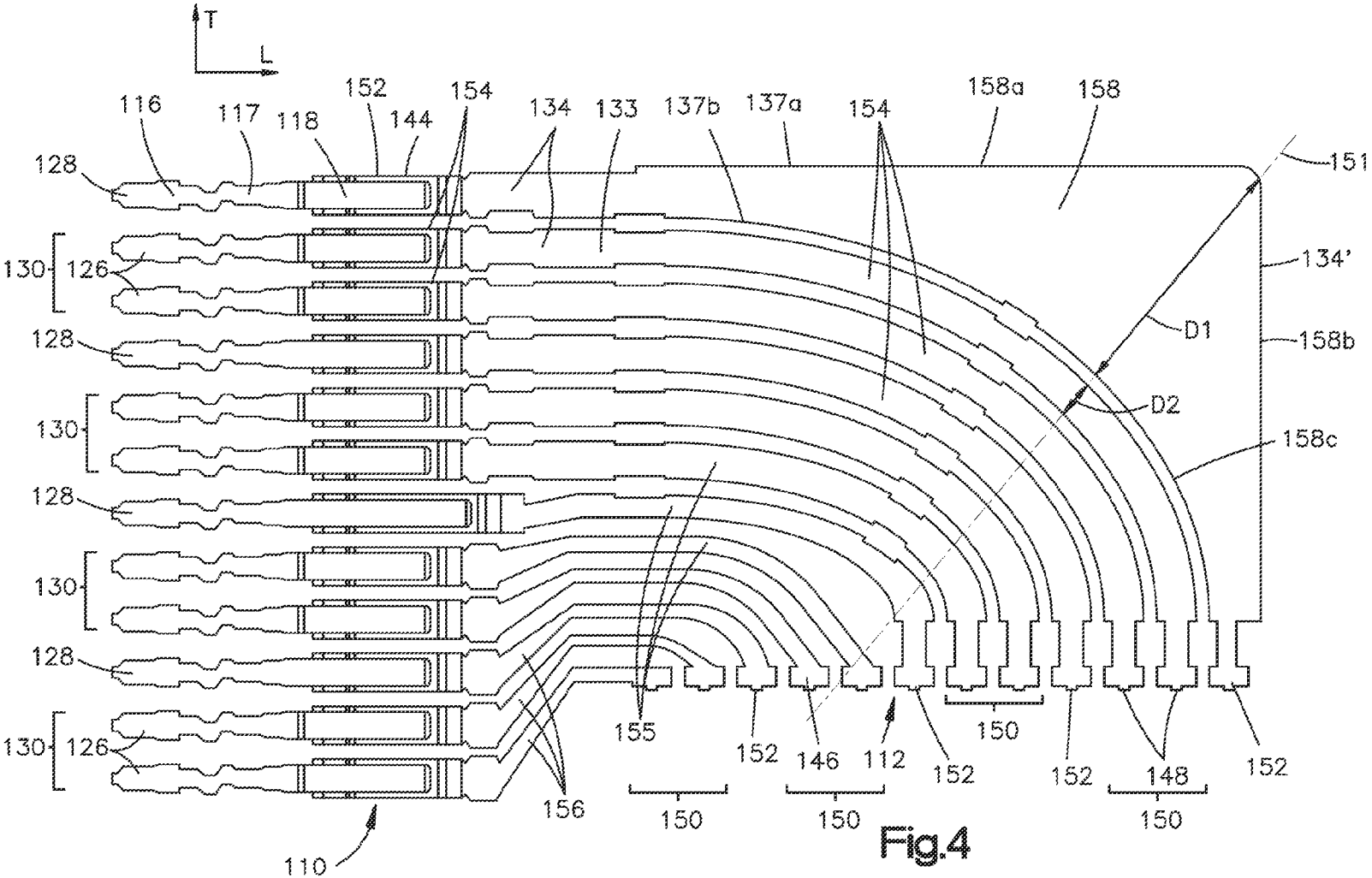
FIG. 4 is a side elevation view of the leadframe assembly illustrated in FIG. 3, with the leadframe housing removed, showing electrical contacts carried by the leadframe assembly.

Referring now to FIGS. 3-4, the first type 136A of leadframe assembly 136 can define an arrangement of the electrical contacts 134 in a repeating ground-signal-signal pattern along the mating interface 110 in a downward direction between the upper and lower ends 138*c* and 138*d*, respectively, of the leadframe housing 138. That is, the portion of the mating interface 110 of the second electrical connector 104 that is defined by the leadframe assembly 136A can be constructed with ground contacts 152 disposed between pairs of signal contacts 148. The pairs of signal contacts 148 can be configured as differential signal pairs 150. In accordance with the illustrated embodiment, the differential signal pairs 150 are edge coupled along a common column C, as described above.

The blade or body 133 of the electrical contacts 134 can define intermediate sections 155 between their respective mating ends 144 and mounting ends 146. The intermediate sections can define offset regions of angulation and/or curvature such that the mating ends 144 and the mounting ends 146 are angularly offset with respect to each other. For example, in accordance with the illustrated embodiment, all but the lowermost electrical contact 134 define curved portions 154 within their respective intermediate sections 155. The illustrated curved portions 154 are defined as a series of concentric curved sections that curve backward and downward extending away from the mating ends 144 toward the mounting ends 146. The six lowermost electrical contacts 134 define respective angled portions 156 within their respective intermediate sections 155. The illustrated angled portions 156 are angled upward and backward away from the mating ends 144. The second to sixth lowermost electrical contacts 134 define both angled portions 156 and curved portions 154 within their respective intermediate sections 155. It should be appreciated that the electrical contacts 134 are not limited to intermediate sections 155 with the illustrated curved portions 154 and/or angled portions 156, and that the electrical contacts 134 can alternatively be constructed with any other contact geometry as desired.

Referring now to FIG. 4, at least a select one 134' of the electrical contacts 134 of at least on up to all of the first type 136A of leadframe assemblies 136 can define a first ground plate 158, which can be metallic, that is disposed between the respective mating end 144 and the respective mounting end 146. Thus, the first ground plate 158 can be integral with the select one 134' of the electrical contacts 134. In accordance with the illustrated embodiment, select one 134' of the electrical contacts 134 is the uppermost electrical contact 134', or the electrical contact 134 whose intermediate section 155 is farthest from the mounting interface 112 with respect to the intermediate sections 155 of the other electrical contacts 134 of the respective first type 136A of leadframe assembly 136. In accordance with the illustrated embodiment, the select electrical contact 134' is a ground contact 152.

In accordance with the illustrated embodiment, the first ground plate 158 extends in an upward direction away from the mounting end 146 and a backward direction away from the mating end 144 so as to define an upper edge 137*a* of the select one 134' of the electrical contacts 134. Furthermore, the first ground plate 158 extends from the intermediate section 155 along a direction away from the adjacent electrical contact 134. The first ground plate 158 defines a first dimension D1 that is at least three times a second dimension D2 of the adjacent electrical contact 134 along a line 151 that extends normal to the intermediate section 155 of the adjacent electrical contact 134 along a plane that is parallel to or coincident with a plane that includes the intermediate sections 155 of the electrical contacts 134. Furthermore, the first ground plate 158 is oriented in a plane that is coplanar with a plane defined by the electrical contacts 134 of the respective leadframe assembly 136. For instance, the first ground plate 158 extends along the column direction C.

In accordance with one embodiment, the first ground plate 158 can extend backward to substantially the rear end 138*b* of the leadframe housing 138 and upward to substantially the upper end 138*c* of the leadframe housing. The illustrated ground plate 158 defines an upper plate edge 158*a* that can be substantially parallel with the upper end 138*c* of the leadframe housing, a rear plate edge 158*b* that can be substantially parallel with the rear end 138*b* of the leadframe housing 138, and a bottom plate edge 158*c* that is substantially coincident with the lower edge 137*b* of the select one 134' of the electrical contacts 134. In accordance with the illustrated embodiment, the first ground plate 158 defines a body that is continuous between the upper, rear, and lower edges 158*a*, 158*b*, 158*c*, respectively. The body of the first ground plate 158 can be substantially coplanar with the select one 134' of the electrical contacts 134 and the electrical contact 134 that is adjacent to the select one 134' of the electrical contacts 134. The first ground plate 158 is configured to induce a shielding effect into the second electrical connector 104, thereby reducing crosstalk exhibited by the second electrical connector 104. For instance, the ground plate 158 can provide shielding between adjacent electrical contacts that define outer differential signal pairs by providing a low impedance path to ground, which captures the fringe fields from these outer pairs. The ground plate 158 can further provide an outer ground reference for the adjacent differential pair, such that the gap width is sized to provide proper impedance.

It should be appreciated that the select one 134' of the electrical contacts 134 is not limited to the uppermost electrical contact 134, and that the first ground plate 158 can be integral with any of the electrical contacts 134 as desired, can extend in any direction as desired, and can define any geometry as desired. It should further be appreciated that while the first ground plate 158 is a continuous body in accordance with the illustrated embodiment, it is not limited to a continuous body. For instance, in alternative embodiments, portions of the body of the first ground plate 158 may be removed, thereby defining at least one, such as a plurality of apertures, slots, grooves, or the like, extending into and/or through the body of the first ground plate 158.

Figure 5:
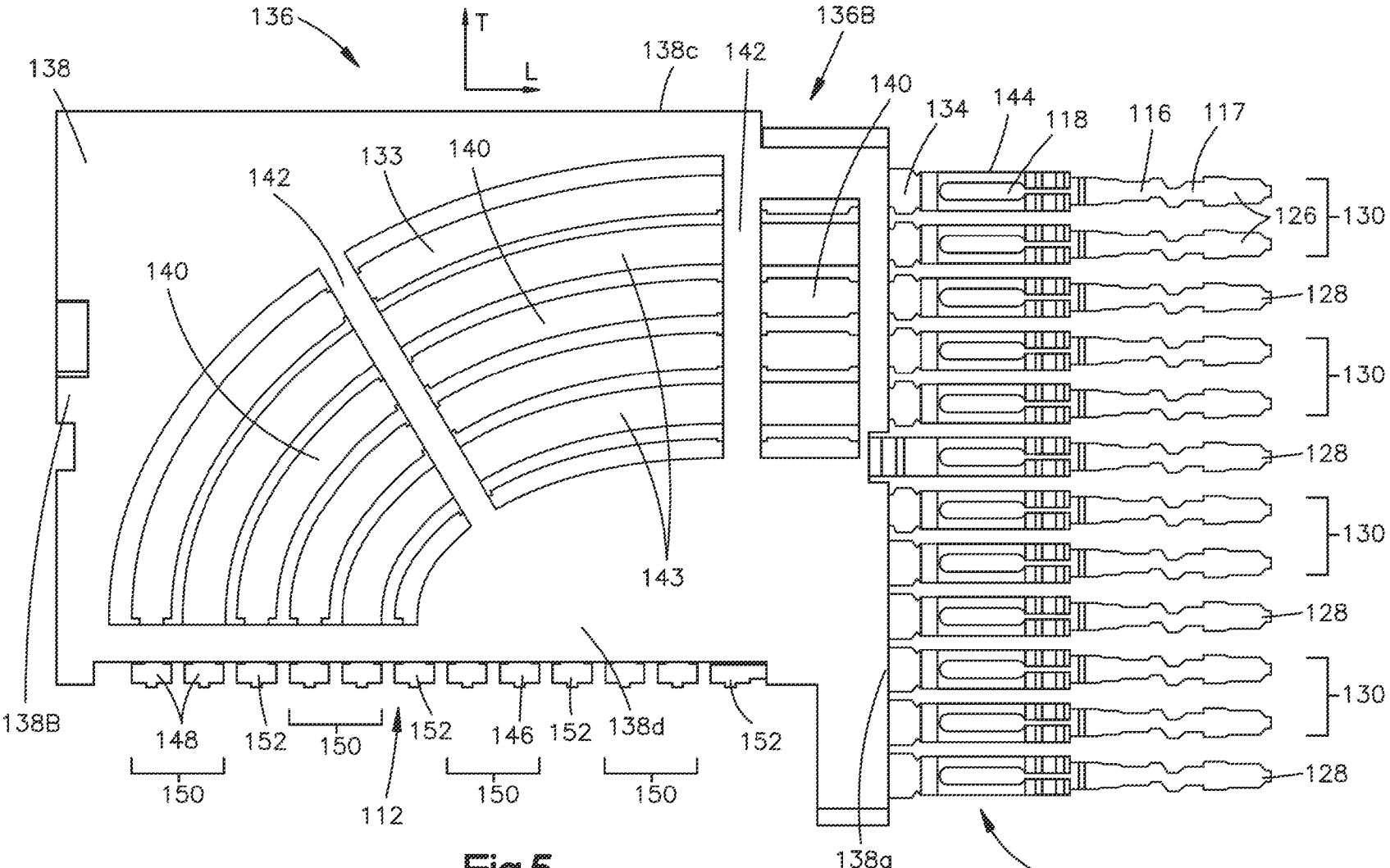
FIG. 5 is a side elevation view of a second type of leadframe assembly of the right angle electrical connector illustrated in FIG. 1 including electrical contacts shown mated to complementary electrical contacts of the vertical connector.
Figure 6:
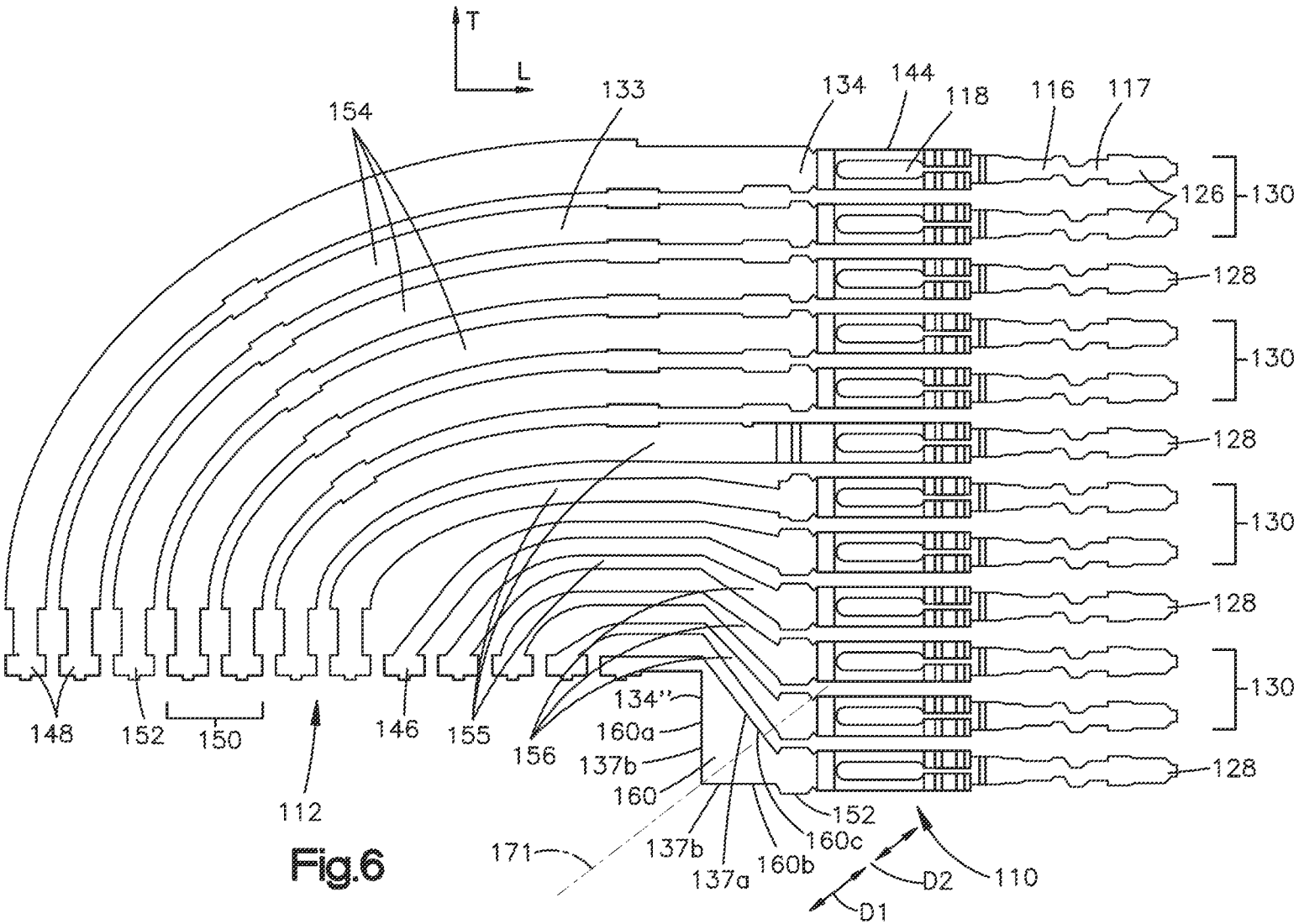
FIG. 6 is a side elevation view of the leadframe assembly illustrated in FIG. 5, with the leadframe housing removed, showing electrical contacts carried by the leadframe assembly.

Referring now to FIGS. 5-6, the second type 136B of leadframe assembly 136 can define an arrangement of the electrical contacts 134 in a second pattern different than the first pattern of the first type 136A of leadframe assembly 136. For instance, the second pattern can be a repeating signal-signal-ground pattern along the mating interface 110 in a downward direction between the upper and lower ends 138*c* and 138*d* of the leadframe housing 138. That is, the portion of the mating interface 110 of the second electrical connector 104 that is defined by the leadframe assembly 136B can be constructed with ground contacts 152 disposed between pairs of signal contacts 148. The pairs of signal contacts 148 can be configured as differential signal pairs 150. In accordance with the illustrated embodiment, the differential signal pairs 150 are edge coupled along a common column C, as described above.

The blade or body 133 of the electrical contacts 134 can define intermediate sections 155 between their respective mating ends 144 and mounting ends 146. The intermediate sections 155 define offset portions of angulation and/or curvature such that the mating ends 144 and the mounting ends 146 are angularly offset with respect to each other. For example, in accordance with the illustrated embodiment, all but the lowermost electrical contact 134 define curved portions 154 within their respective intermediate sections 155. The illustrated curved portions 154 are defined as a series of concentric curved sections that curve backward and downward extending away from the mating ends 144 toward the mounting ends 146. The six lowermost electrical contacts 134 define respective angled portions 156 within their respective intermediate sections 155. The illustrated angled portions 156 are angled upward and backward away from the mating ends 144. The second to sixth lowermost electrical contacts 134 define both angled portions 156 and curved portions 154 within their respective intermediate sections 155. It should be appreciated that the electrical contacts 134 are not limited to intermediate sections 155 with the illustrated curved portions 154 and/or angled portions 156, and that the electrical contacts 134 can alternatively be constructed with any other contact geometry as desired.

Referring now to FIG. 6, at least a select one 134" of the electrical contacts 134 of the second type 136B of leadframe assembly 136 can define a second ground plate 160, which can be metallic, that is disposed between the respective mating end 144 and the respective mounting end 146. Thus, the metallic ground plate 160 can be integral with the select one 134" of the electrical contacts 134. In accordance with the illustrated embodiment, the select one 134" of the electrical contacts 134 is the lowermost electrical contact 134, or the electrical contact 134 whose intermediate section 155 is closest to the mounting interface 112 with respect to the intermediate sections 155 of the other electrical contacts 134 of the respective second type 136B of leadframe assembly 136. In accordance with the illustrated embodiment, the select electrical contact 134" is a ground contact 152. In accordance with the illustrated embodiment, the second ground plate 160 extends in an downward direction toward the mounting end 146 and a forward direction toward the mating end 144 so as to define a lower edge 137*b* of the select one 134" of the electrical contacts 134.

In accordance with the illustrated embodiment, the second ground plate 160 defines a rear plate edge 160*a* that can be substantially parallel with the rear end 138*b* of the leadframe housing, a lower plate edge 160*b* that can be substantially parallel with the lower end 138*b* of the leadframe housing 138, and an upper plate edge 160*c* that is substantially coincident with the upper edge 137*a* of the lowermost electrical contact 134. In accordance with the illustrated embodiment, the second ground plate 160 defines a body that is continuous between the rear, lower, and upper plate edges 160*a*, 160*b*, 160*c*, respectively. The body of the second ground plate 160 can be substantially coplanar with the lowermost electrical contact 134. In accordance with the illustrated embodiment, the second ground plate 160 protrudes from the lower edge 137*b* of the lowermost electrical contact 134 in a rearward direction toward the rear end 138*b* of the leadframe housing 138. The second ground plate 160 can protrude rearward from the angled portion 156 of the lowermost electrical contact 134, in a direction away from the mating end 144. Furthermore, the second ground plate 160 extends from the intermediate section 155 along a direction away from the adjacent electrical contact 134. The second ground plate 160 defines a first dimension D1 that is at least three times a second dimension D2 of the adjacent electrical contact 134 along a line 171 that extends normal to the angled portion 156 of the adjacent electrical contact 134. Furthermore, the first ground plate 158 is oriented in a plane that is coplanar with a plane defined by the electrical contacts 134 of the respective leadframe assembly 136. For instance, the first ground plate 158 extends along the column direction C. The second ground plate 160 is configured to induce a shielding effect into the second electrical connector 104, thereby reducing crosstalk exhibited by the second electrical connector 104. For instance, the second ground plate 160 can provide shielding between adjacent electrical contacts that define outer differential signal pairs by providing a low impedance path to ground, which captures the fringe fields from these outer pairs. The ground plate 160 can further provide an outer ground reference for the adjacent differential pair, such that the gap width is sized to provide proper impedance.

It should be appreciated that the select one 134" of the electrical contacts 134 is not limited to the lowermost electrical contact 134, and that the second ground plate 160 can be integral with any of the electrical contacts 134 as desired, can extend in any direction as desired, and can define any geometry as desired. It should further be appreciated that while the second ground plate 160 is a continuous body in accordance with the illustrated embodiment, it is not limited to a continuous body. For instance, in alternative embodiments, portions of the body of the second ground plate 160 may be removed, thereby defining at least one, such as a plurality of apertures, slots, grooves, or the like, extending into and/or through the body of the second ground plate 160.

It should thus be appreciated that the first type 136A of leadframe assembly 136 can define a first ground plate 158, and the second type 136B of leadframe assembly 136 can define a second ground plate 160 that has at least one positional characteristic that is different with respect to the first ground plate 158. Accordingly, in accordance with one embodiment, the first and second ground plates 158 and 160 are positioned at different locations with respect to the respective leadframe housings 138, and are not aligned with each other when the first and second types 136A and 136B of leadframe assemblies 136 are supported by the connector housing 132. For instance, in the illustrated embodiment, a straight laterally extending line can not pass through both the first and second ground plates 158 and 160. Furthermore, the first and second ground plates 158 and 160 extend in different directions, which can be substantially opposite, for instance directly opposite, directions in accordance with the illustrated embodiment. Additionally, the first and second ground plates 158 and 160 can extend from different ends of the respective leadframe housings 138 in accordance with the illustrated embodiment. The first and second ground plates 158 and 160 can also alternate between respective leadframe housings such that one leadframe housing has a first ground plate 158 but not a second ground plate 160, a leadframe assembly immediately adjacent to the one leadframe housing 138 has a second ground plate 160 but not a first ground plate 158, and the first and second ground plates each extend in directions opposed to one another. The second ground plate 160 can be positioned adjacent the differential signal pairs of an immediately adjacent leadframe housing, wherein the differential signal pairs are physically or electrically shorter than other differential signal pairs within the immediately adjacent leadframe housing.

Although the electrical connector with ground plates has been described herein with reference to preferred embodiments and/or preferred methods, it should be understood that the words which have been used herein are words of description and illustration, rather than words of limitation, and that the scope of the instant disclosure is not intended to be limited to those particulars, but rather is meant to extend to all structures, methods, and/or uses of the herein described electrical connector with ground plates. Those skilled in the relevant art, having the benefit of the teachings of this specification, may effect numerous modifications to the electrical connector with ground plates as described herein, and changes may be made without departing from the scope and spirit of the instant disclosure, for instance as recited in the appended claims.

What is claimed:

1. An electrical connector comprising:

a connector housing; and a first leadframe assembly supported by the connector housing, the first leadframe assembly including a first leadframe housing and a first plurality of electrical contacts supported by the first leadframe housing and arranged in a column direction, each electrical contact of the first plurality of electrical contacts including a mating end, an opposed mounting end, and an intermediate section that is curved from the mating end to the mounting end, wherein 1) the first plurality of electrical contacts defines a first uppermost electrical contact having a first uppermost mating end along the column direction and a first lowermost electrical contact having a first lowermost mating end along the column direction, and 2) the first uppermost electrical contact defines a first ground plate that protrudes from the intermediate section of the first uppermost electrical contact along a first direction that is away from the intermediate section of a first adjacent electrical contact that is immediately adjacent the first uppermost electrical contact; and a second leadframe assembly supported by the connector housing immediately adjacent the first leadframe assembly, the second leadframe assembly including a second leadframe housing and a second plurality of electrical contacts supported by the second leadframe housing and arranged in the column direction, each electrical contact of the second plurality of electrical contacts including a mating end, an opposed mounting end, and an intermediate section that extends from the mating end to the mounting end, wherein 1) the second plurality of electrical contacts defines a second uppermost electrical contact having a second uppermost mating end along the column direction and a second lowermost electrical contact having a second lowermost mating end along the column direction, 2) the second lowermost electrical contact defines a second ground plate that protrudes from the intermediate section of the lowermost electrical contact, and 3) the second leadframe assembly is devoid of any ground plates that extend away from the intermediate section of the second uppermost electrical contact along a second direction that is away from the intermediate section of a second adjacent electrical contact that is immediately adjacent the second uppermost electrical contact.

2. The electrical connector of claim 1, wherein the first ground plate protrudes from an upper edge of the intermediate section of the at least one first electrical contact, and the second ground plate protrudes from a lower edge of the intermediate section of the at least one second electrical contact.

3. The electrical connector of claim 1, wherein the electrical connector does not define a straight line that extends along the lateral direction through both of the first and second ground plates.

4. The electrical connector of claim 1, wherein the first ground plate defines a first dimension that is at least three times a second dimension of the intermediate section of the first adjacent electrical contact along a line that extends along the first direction, wherein the first direction is normal to the intermediate section of the first adjacent electrical contact.

5. The electrical connector of claim 1, wherein the second ground plate defines a second that is at least three times a second dimension of the intermediate section of a adjacent electrical, that is adjacent the second lowermost electrical contact, along a line that extends along a direction that is normal to the intermediate section of the second adjacent electrical contact.

6. The electrical connector of claim 1, wherein the first leadframe is devoid of any other ground plates other than the first ground plate.

7. The electrical connector of claim 1, wherein the first plurality of electrical contacts includes ground contacts and signal contacts, and adjacent ones of the signal contacts define respective differential signal pairs.

8. The electrical connector of claim 7, wherein the first plurality of electrical contacts are arranged in a ground-signal-signal arrangement, and the first uppermost electrical contacts is one of the ground contacts.

9. The electrical connector of claim 1, wherein the second plurality of electrical contacts includes ground contacts and signal contacts, and adjacent ones of the signal contacts define respective differential signal pairs.

10. The electrical connector of claim 9, wherein the second plurality of electrical contacts are arranged in a ground-signal-signal arrangement, and the second lowermost electrical contacts is one of the ground contacts.

11. The electrical connector of claim 1, wherein the mounting ends of each of the first and second plurality of electrical contacts is perpendicular to the mating end of each of the first and second plurality of electrical contacts.

* * * * *